United States Patent [19]

McReynolds et al.

[11] Patent Number: 5,075,902

[45] Date of Patent: Dec. 31, 1991

[54] SHORTS WITH DETACHABLE ELASTIC BELTS AT THE CUFFS HAVING DETACHABLE WEIGHT COMPARTMENTS

[76] Inventors: Billy J. McReynolds, 4127 N. 86th Dr., Phoenix, Ariz. 85037; James M. McBride, 1123 E. Grandview, Phoenix, Ariz. 85022

[21] Appl. No.: 594,425

[22] Filed: Oct. 9, 1990

[51] Int. Cl.[5] ..... A63B 21/00

[52] U.S. Cl. ..... 2/238; 2/227; 2/79; 272/119

[58] Field of Search ..... 2/238, 67, 227, 79, 2/69, DIG. 6; 272/119

[56] References Cited

U.S. PATENT DOCUMENTS

| | | | |
|---|---|---|---|
| 3,532,339 | 10/1970 | Smith | 272/119 |
| 3,759,510 | 9/1973 | Jackson, Jr. | 272/119 |
| 4,268,917 | 5/1981 | Massey | 272/119 |
| 4,382,302 | 5/1983 | Watson | 272/119 |
| 4,384,369 | 5/1983 | Prince | 272/119 |
| 4,407,497 | 10/1983 | Gracie | 2/67 |
| 4,586,506 | 5/1986 | Nangle | 272/119 |
| 4,602,387 | 7/1986 | Zakrewski | 272/119 |
| 4,958,386 | 9/1990 | Louis-Jeune | 272/119 |

*Primary Examiner*—Werner H. Schroeder
*Assistant Examiner*—Gloria Hale
*Attorney, Agent, or Firm*—Richard G. Harrer; Charles E. Cates

[57] ABSTRACT

A weighted training garment comprising a pair of shorts having portions which surround each thigh area of the user supplied with weights contained in a cuff-like device. The shorts are constructed of a fabric having substantially greater stretch in a direction lateral to the vertical axis of the wearer's body using fibers such as spandex, nylon, and blends thereof. The cuff device includes a series of weight containing compartments which are connected to one another by a flexible, elasticized fabric belt which stretches primarily in the lateral direction. The cuff devices are removably secured to the thigh portion of the shorts by "Velcro" fastening tape or other suitable fastening means. The weight containing compartments may also be openable and closeable to allow the addition or removal of weights and may also include fastening means of a type that they can be removably connected to the thigh portion of the shorts or to the cuff-like device.

10 Claims, 1 Drawing Sheet 54
50
52
62
56
58
64

10
26
22
16
12
14

10
22
12
24
28

12
22
28
24
16
18
24
22
28
24

30
32
40
42
34
34
44
38
46
36
46
10
10

56
50
52

SHORTS WITH DETACHABLE ELASTIC BELTS AT THE CUFFS HAVING DETACHABLE WEIGHT COMPARTMENTS

This invention relates to an improved exercise or training garment to be used by athletes and others to increase endurance, strength and running speed.

BACKGROUND OF THE INVENTION

For a number of years, athletes and others have used added weight to their bodies both above and below the waist to develop greater endurance, strength and, for example, running speed. The use of such weights is, of course, not confined to athletes, and are regularly used by physical therapists for muscle development in patient's who have undergone, for example, knee or hip surgery. Such a training aide usually comprises a fabric bag which is filled with lead weights and can be fastened about the waist or ankle.

In the particular area of developing greater speed and endurance in running, there seems to be some who favor the use of added weight above the waist. For example, U.S. Pat. No. 4,658,442 discloses a weighted vest which is said to be one of the best methods to develop running speed and endurance. Then again, in U.S. Pat. No. 4,303,239 a thigh muscle exercise device is disclosed which is said to be preferable to ankle weights. In any event, our observations lead to the conclusion that added weight in the thigh area, particularly in the area immediately above the knee, serves very well indeed to increase endurance, strength and running speed. Our experience is that providing weight in this area for runners provides a more concentrated exercise for the hip flexor and hip extensor muscles. Additionally, in light aerobic exercises we find that added weight in the thigh area above the knee provides a very good exercise for the abductor and adductor muscles.

Various types of exercise garments or devices have been described which do provide for added weight in various body areas, including the thigh. For example, U.S. Pat. No. 3,759,510 provides a composite exercise garment which includes a helmet, jacket, armlets, gloves, thigh leggings, calf leggings, and boots. In this composite garment, pockets are provided in the thigh area for receiving weights. U.S. Pat. No. 4,180,261 discloses an exercise device particularly designed for runners which includes exercising weights contained in pockets which surround the front of a runner's thighs, with upper and lower thigh encircling adjustable belts to properly position and keep the weights in place. U.S. Pat. No. 4,303,329 also discloses a thigh muscle exercise device which discloses a rather complicated and perhaps somewhat cumbersome device which is utilized to exercise the thigh area. U.S. Pat. No. 4,384,639 discloses an exercise suit which includes jacket and pants having numerous pockets for carrying weights. Although the various garments and devices heretofore described are likely to be effective in assisting in the improvement of strength, stamina and skills, certainly the garments are in a sense "over kill" when the major thrust of the exercise is to develop the thigh muscles, as for example, usually required by runners. Additionally, the devices shown in U.S. Pat. Nos. 4,180,261 and 4,303,239, although specific for exercising and developing the thigh area, are extremely complicated in construction and likely to be of such a cost that it may be prohibitive to supply to a group of persons training for running, such as a school track team.

SUMMARY OF THE INVENTION

A training or exercise garment is provided wherein exercising weights are contained in a cuff-like device which surrounds the wearer's thighs, preferably in the area just above the knee. In a preferred embodiment, the training garment includes training shorts which are worn by the user and which not only fit tightly to the user's body but are constructed of a fabric which has substantially greater stretch in the direction lateral to the vertical axis of the wearer's body than in a direction parallel to such axis. In addition, the interior of each thigh area of the shorts in the area where the cuff-like device is attached can be lined with an elasticized fabric which will stretch in a direction lateral to the vertical axis of the wearer's body. Surrounding each thigh area on the exterior of the shorts is the cuff-like assembly which is provided with a series of compartments or pockets containing appropriate weights. The cuff assembly is preferably attached to the exterior of the thigh area of the shorts by means of a "Velcro" ® fastener or snaps so that the assembly may be readily attached to or removed from the shorts.

DETAILED DESCRIPTION OF THE PRESENTLY PREFERRED EMBODIMENTS

Figures 1, 2, 3, 4, 5, 6:
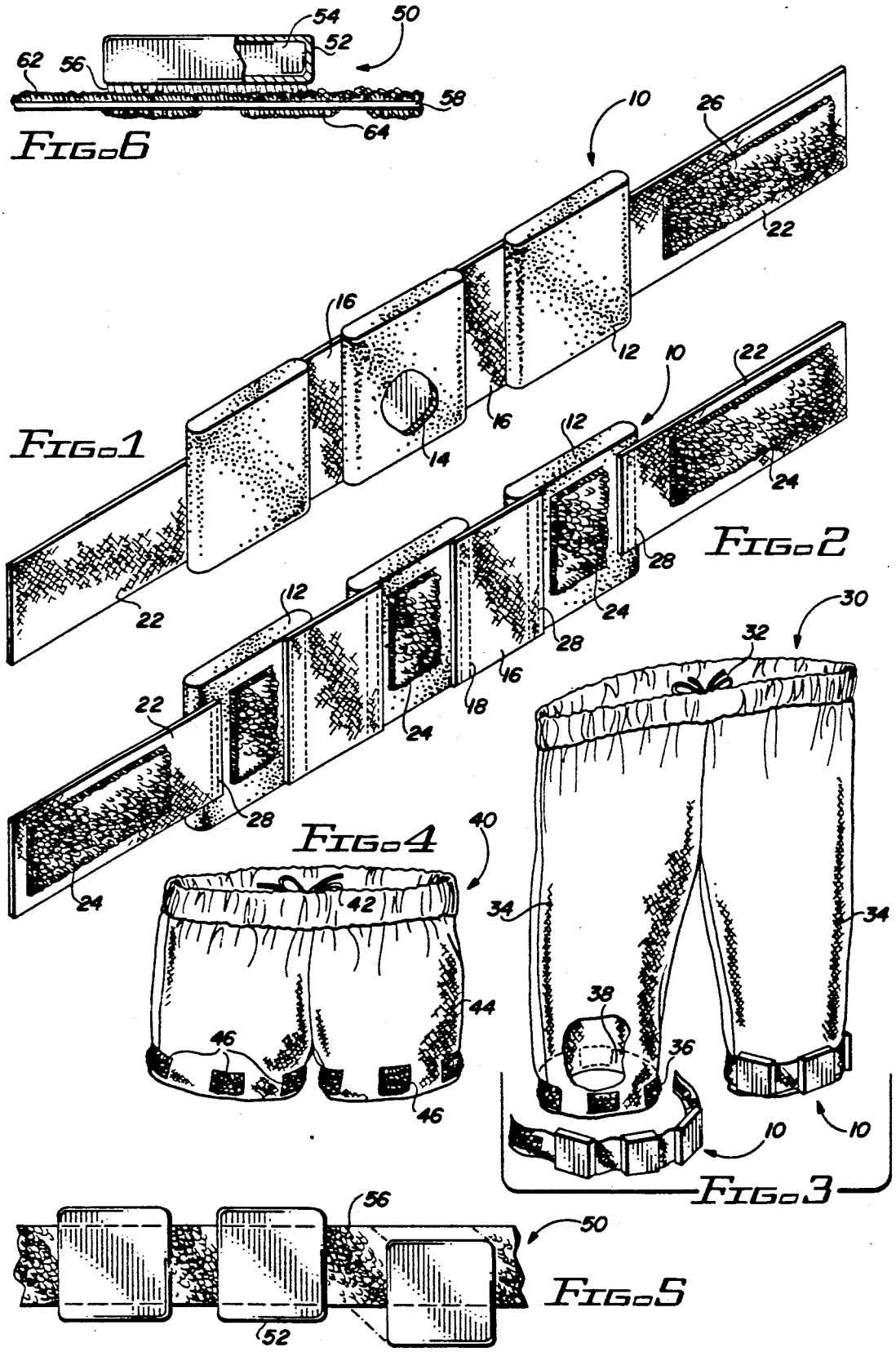
FIG. 1 is a front perspective view of the weight containing cuff assembly.
FIG. 2 is a back perspective view of the weight containing cuff assembly of FIG. 1.
FIG. 3 is a perspective view of a pair of shorts showing the cuff assembly positioned on the lower portion of the thigh area of the shorts just above the knee.
FIG. 4 is a perspective view of another pair of shorts adapted to receive the cuff assembly.
FIG. 5 is a front view of another embodiment of a cuff assembly wherein the individual weight containing pockets are removable.
FIG. 6 is a sectional view taken on the line 6—6 of FIG. 5.

As shown in FIGS. 1–4, in one embodiment of the present invention, the garment includes a cuff-like device 10 and training shorts 30 with the cuff device being positioned on and secured to the exterior of each thigh area of the shorts. As shown best in FIGS. 1 and 2, cuff device 10 includes a series of compartments or pockets 12 with weights 14 contained within each compartment. The compartments can be made of fabric, sheet plastic or other suitable material, and although not shown, each compartment or pocket may be provided with means for inserting and/or removing the weights 14. The weights are preferably made of a solid piece of lead or lead shot. A section of flexible fabric material 16 connects adjacent compartments to form a unitary structure. Preferably, sections 16 are made of an elasticized fabric which will stretch in a lateral direction. As best shown in FIG. 2, fabric section 16 is fastened to the ends of adjacent compartments 12 by means of stitching 18 or other suitable fastening means. Also, as shown in FIG. 2 the side of each compartment of cuff device 10 which is in contact with the training shorts 30 is provided with a piece of "Velcro" fastening tape 24.

The structure of the cuff assembly is completed by securing an elongated flexible flap 22 to each of the end compartments 12 and, as shown, this is readily accomplished by stitching 28 or other suitable fasteners. As shown, each side of one of the flexible flaps 22 is provided with a piece of "Velcro" fastening tape 24 and 26 and the opposite flap has tape 24 on only one side. In a preferred construction, flaps 22 are made of an elasticized fabric which stretches primarily in a lateral direction.

FIGS. 3 and 4 show specialized shorts 30 and 40 having a waist band provided with a drawstring 32 and 42. Shorts 30 are provided with thigh portions 34 which extend to about the area of the wearer's knee, whereas in shorts 40 the thigh area is somewhat shorter and ends above the wearer's knee. Shorts 30 and 40 are constructed of a fabric which has substantially greater stretch in a direction lateral to the vertical axis of the wearer's body than in a direction parallel to such axis. A very suitable fabric is one containing the elastomeric fiber spandex and nylon, specifically about 20% of spandex and about 80% of nylon. A specific preferred fabric is called a "compression fabric" and comprises about 46% cotton, 46% polyester and about 8% of spandex. The bottom end of the thigh area of shorts 30 and 40 is provided with fastening means 36 and 46 respectively. Specifically, lengths of "Velcro" fastening tape 36 and 46 are secured about the perimeter of the bottom end of thigh areas 34 and 44. The purpose of tape 36 and 46 is to secure the cuff device 10 to the exterior of the bottom end of the training shorts 30 and 40. Thus, Velcro tape 36 and 46 makes contact with the sections of Velcro tape 24 of the cuff device and secures the device to the shorts. Additionally, and as shown in FIG. 3, the interior of each thigh area of the shorts where cuff device 10 is attached is lined with a length of elasticized fabric 38, which, as with other elasticized materials used in the training garments stretches primarily in a lateral direction to the vertical axis of the wearer's body. The use of this elasticized fabric is not critical when using the compression fabric identified above.

To use the training garment, the user puts on shorts 30 or 40 and then places cuff device 10 over the Velcro tape 36 or 46 so that the tape makes good contact with the sections of tape 24 on the back of the compartments 12. After this has been accomplished, the user then joins together the elasticized connecting bands 22 by means of the "Velcro" fastening tape 24.

FIGS. 6 and 7 show a further embodiment of the cuff device of FIGS. 1 and 2. The cuff device shown generally at 50 includes a series of compartments 52 provided with weights 54, which compartments and weights are virtually identical to compartments 12 of the embodiment shown in FIGS. 1 and 2. One side of each Weight containing compartment 52 is provided with fastening tape 56 or other appropriate fastening means. An elasticized fabric belt 58 is provided on one side with a continuous layer of fastening tape 62 which contacts tape 56 of compartment 52. The opposite side of belt 58 is provided with sections of fastening tape 64. The entire cuff assembly may be easily secured to either fastening means 36 or 46 of shorts 30 and 40. Thus, compartments 52 may be easily added to or removed from belt 56 allowing the user to readily adjust the amount of weight in the thigh area during training.

It is also a feature that a number of compartments 52 including weight 54 and its attached fastening tape 56 may be secured directly to fastening means 36 or 46 of shorts 30 and 40.

As will be understood from the foregoing description, this invention provides training shorts which, although relatively simple in construction, are very effective in use. The cuff-like device, which provides the needed weight, is readily secured to and removable from the shorts. This is important in that the user has the option of training for a period without the added weight, and then is able to easily secure the needed weight to the shorts for an additional period of time. The fact that the cuff-like device is readily removable from the shorts is also important in that the shorts may be easily laundered without interference from the cuff device. Moreover, experience has taught that providing weight in the thigh area must be done in such a manner that the "bounce" of the weight, particularly in a vertical direction, be held to a minimum. The present invention accomplishes this in several ways. First of all, the shorts themselves are constructed of a special fabric, that is, a fabric which although is stretchable in a lateral direction, has substantially less stretch in a vertical direction. Thus, the thigh area of the shorts tightly grip the user's thighs. Moreover, elasticized fabric may be provided in the interior of the thigh area of the shorts where the cuff like device is to be secured and this further enhances or increases the grip of the thigh area of the shorts around the user's thigh. Additionally, the cuff-like device itself is constructed, in a most preferred version, using elasticized fabric to connect each of the weight containing compartments. Here again this elasticized fabric will stretch in a lateral direction, but to a much lesser degree in the vertical direction. Thus the construction of the shorts and cuff device work together to provide the least amount of "bounce" of the weights in a vertical direction, which results in considerably more comfort to the user while in training.

We claim:

1. A training garment for providing exercise weight in the thigh area of the user comprising shorts having portions thereof which surround each thigh area of the user, said shorts constructed a fabric having substantially greater stretch in a direction lateral to the vertical axis of the user's body than in a direction parallel to such axis, a cuff device positioned on and removably secured to a thigh area of said shorts, said cuff device comprising a series of weight containing compartments which compartments are connected one to the other by means of a flexible, elasticized fabric which will stretch primarily in a lateral direction, and means on said shorts and on said cuff for removably securing said cuff device to the thigh area of said shorts.

2. The garment of claim 1 wherein said shorts contain a proportion of the elastomeric fiber spandex.

3. The garment of claim 2 wherein said compartments are provided with means for inserting or removing said weights.

4. The garment of claim 2 wherein said compartments are removably secured to said cuff, said cuff is a length of an elasticized fabric belt which has substantially greater stretch in a direction lateral to the vertical axis of the wearer's body than in a direction parallel to such axis.

5. The garment of claim 2 wherein the interior side of the thigh area of said shorts where said cuff device is attached is lined with a length of elasticized fabric.

6. The garment of claim 2 wherein said shorts are constructed of a fabric having about 20% spandex fiber and about 80% nylon fiber.

7. The garment of claim 6 wherein said fabric of said shorts is a compression fabric including cotton, polyester and spandex fibers.

8. The garment of claim 7 wherein said compression fabric includes about 46% cotton fibers, about 46% polyester fibers and about 8% spandex fibers.

9. The garment of claim 1 wherein said compartments are provided with means to removably secure said compartments to the thigh area of said shorts.

10. The garment of claim 1 wherein said cuff device is secured to said shorts in the area immediately above the knee.

* * * * *